US006001179A

United States Patent [19]

Ueberschär et al.

[11] Patent Number: 6,001,179

[45] Date of Patent: Dec. 14, 1999

[54] COATING MEDIUM APPLICATOR WITH GUIDE SURFACE

[75] Inventors: Manfred Ueberschär, Nattheim; Jürgen Mittag, Heidenheim, both of Germany

[73] Assignee: Voith Sulzer Papiermaschinen GmbH, Heidenheim, Germany

[21] Appl. No.: 08/989,298

[22] Filed: Dec. 11, 1997

[30] Foreign Application Priority Data

Dec. 12, 1996 [DE] Germany ..... 196 51 739

[51] Int. Cl.[6] ..... B05C 3/12

[52] U.S. Cl. ..... 118/410; 118/419; 239/456; 239/457; 239/597; 427/356

[58] Field of Search ..... 118/410, 413, 118/419; 427/356; 239/455, 456, 457, 597

[56] References Cited

U.S. PATENT DOCUMENTS

| | | | |
|---|---|---|---|
| 4,551,204 | 11/1985 | Holik et al. | 162/336 |
| 4,688,516 | 8/1987 | Sommer | 118/410 |
| 4,903,632 | 2/1990 | Sollinger | 118/123 |
| 5,436,030 | 7/1995 | Damrau | 427/240 |
| 5,785,253 | 7/1998 | Ueberschar et al. | 239/455 |

FOREIGN PATENT DOCUMENTS

| | | | |
|---|---|---|---|
| 34 46 525 A1 | 8/1985 | Germany | 118/410 |
| 84 00 325 U | 8/1985 | Germany . | |
| 34 20 412 | 8/1995 | Germany . | |
| 44 32 177 A1 | 3/1996 | Germany . | |
| 295 20 678 U | 7/1996 | Germany . | |
| 2272390 | 5/1994 | United Kingdom . | |

*Primary Examiner*—Katherine A. Bareford
*Attorney, Agent, or Firm*—Taylor & Associates, P.C.

[57] ABSTRACT

An applicator for direct or indirect application of a liquid or pasty coating medium onto a traveling fiber material web, notably of paper or cardboard, includes at least one metering system with a metering slot configured as an open-jet nozzle and formed between an approach-side lip and a departure-side lip. The applicator includes at least one guide surface bordering on the exit of the metering slot and intended for the coating medium issuing as an open jet out of the metering slot. The length of the guide surface is adjustable in at least one direction substantially parallel to the flow direction of the coating medium along the guide surface.

1 Claim, 6 Drawing Sheets

COATING MEDIUM APPLICATOR WITH GUIDE SURFACE

BACKGROUND OF THE INVENTION

1. Field of the Invention

The present invention relates to an apparatus for direct or indirect application of a liquid or pasty coating medium onto a traveling material web, notably of paper or cardboard.

2. Description of the Related Art

Apparatuses are used in so-called coating systems for providing a traveling material web, formed for example of paper, cardboard or a textile material, on one or both sides with one or several layers of the coating medium, for example color, starch, impregnating fluid or the like.

In the so-called direct application, the liquid or pasty coating medium is applied by an applicator system directly onto the surface of the traveling fiber material web, the latter being carried during application on a rotating countersurface, for example an endless belt or a backing roll. In the indirect application of the medium, the liquid or pasty coating medium is first applied onto a substrate, for example the surface of a backing roll configured as an applicator roll, and is then transferred from the substrate to the fiber material web in a nip through which the material web passes.

Known from U.S. Pat. No. 5,436,030 is an applicator for direct or indirect application of a liquid or pasty coating medium onto a traveling fiber material web, notably of paper or cardboard, which includes a metering system with a metering slot configured as an open-jet nozzle and formed between an approach-side lip and a departure-side lip. Owing to the configuration of the open jet of liquid or pasty medium proceeding through the ambient atmosphere, such applicators are also known by the trade name "Fountain Jet Flow Applicator." Of the two lips forming the metering slot, the one disposed on the side of the metering slot which, in the indirect application of the medium, the applicator roll rotates toward, or, in the direct application of the medium, the fiber material web runs toward, is called the approach-side lip. Accordingly, the second lip, located on the side of the metering slot from which the applicator roll or fiber material web departs from the applicator, is called the departure-side lip. In one embodiment of an applicator according to U.S. Pat. No. 5,436,030, a concavely curving guide surface for the liquid or pasty coating medium, bordering on the metering slot, is arranged on the free end of the approach-side lip or the departure-side lip.

An applicator comparable with the applicator according to U.S. Pat. No. 5,436,030 is also being marketed by the assignee of the present invention under the trade name "Jet Flow F." The German patent application P 44 32 177.5-51, assigned to the assignee of the present invention, discloses an adjustment system that is usable in a "Jet Flow F Applicator" and that allows adjusting the approach-side lip manually or automatically with respect to its clearance from the departure-side lip. Viewed across the width of the applicator, the clearance can be adjusted zonewise differently by use of actuators, so as to even out, e.g., localized production inaccuracies and/or realize a desired cross profile of the applied liquid or pasty medium. The cross profile may sectionally vary, for example, by being flattened at the edges of the fiber material web. Also possible is a coarse adjustment of the entire metering slot extending across the width of the applicator. Usually coordinated with each adjustment zone are one or several actuators that are placed at a specific sideways spacing relative to one another. The correct choice of the mutual clearances between the respective actuators is particularly important for optimum adjustment of a desired cross profile.

It has been found, though, that the adjustment of an individual actuator has, with respect to the longitudinal expanse of the metering slot or the machine width direction, an effect on the section of the flow of liquid or pasty coating medium. The flow of coating medium is normally to be influenced by adjacent actuators. Thus, the adjustment of an individual actuator affects the resulting cross profile. For example, the local enlargement of the metering slot depth occasioned by actuation of an individual actuator at a profile spot causes a local variation of the amount of coating medium traversing a preset unit area. The variation nonetheless can still be limited to the area of the adjustment zone of the operated actuator. Until the coating medium impinges on the surface of the traveling fiber material web or the applicator roll, however, sort of a spreading effect or evening effect occurs in machine cross direction in the jet of coating medium. Thus, a zonewise variation of the cross profile results from the originally locally restricted variation of the amount of coating medium. This effect on the cross profile, caused by an individual actuator, is hereinafter called "influential width."

Due to the mutual influencing of the respective actuators of a metering slot adjustment system and the resulting superimposition of the influential widths of adjacent actuators, an even cross profile can obviously be achieved only at relatively high control expense. Besides, the influential width resulting from an individual actuator depends upon various design-related technical parameters of the applicator and/or on the properties of the coating medium used, for example, total pump output or total volume flow of the applicator, operating speed, rheology of the coating medium, etc. The user of a finished applicator is no longer able to influence these parameters.

SUMMARY OF THE INVENTION

The present invention provides an improved applicator. The applicator, after the fashion of the "Jet Flow F" described above, is such that the influential width of the individual actuators can be manipulated. An exact adjustment of the desired final cross profile, and thus a high quality final product, can be accomplished easily and effectively. The present invention also provides an appropriate, suitable method for adjustment of a desired cross profile of a liquid or pasty medium applied by use of such applicator onto a traveling fiber material web, notably of paper or cardboard.

This applicator for direct or indirect application of a liquid or pasty coating medium onto a traveling material web, notably of paper or cardboard, includes at least one metering system with a metering slot configured as an open-jet nozzle and formed between an approach-side lip and a departure-side lip. The applicator includes at least one guide surface for the coating medium issuing as an open jet out of the metering slot. The guide surface borders on the exit of the metering slot and its length is adjustable in at least one direction substantially parallel to the flow direction of the coating medium along the guide surface, that is, in the direction of at least one tangent to the side surface. Consequently, the invention also provides for effective length adjustment, depending on the configuration of the guide surface, not only in a single direction (wherein the guide surface is shortened of lengthened), but also in several directions, wherein the directional vectors may intersect.

Owing to the lengthwise adjustability of the guide surface, the length of stream guidance of the coating medium issuing out of the metering slot and flowing along the guide surface, and thus the properties of the jet, notably its local flow velocity and thus the local rate of flow of the coating medium or the jet width, can be influenced independently of any possible adjustment of the metering slot depth itself. The inventors of the present inventional object recognized that the velocity of the open jet depends substantially on the friction of the flowing coating medium along the guide surface, and thus on the length of the guide surface in the flow direction. This effect can be utilized to influence the cross profile. Hence, the length change of the guide surface allows manipulating the influential width caused by the individual actuators of the metering slot adjustment system. Thus, the length change of the guide surface easily and effectively enables a more exact adjustment of the desired final cross profile and thus the production of a high quality final product. Moreover, the adjustability of the guide surface length offers the user of the applicator the option of varying the influential width of one or several actuators as needed, despite preset technical parameters of the applicator and/or the coating medium used. Such preset parameters cannot be varied by the user.

According to a feature of the inventional applicator, the length of the at least one guide surface allows zonewise adjustment across the machine width. This allows a variation and adjustment of the influential width of an actuator at a particular spot of the profile and thus easily enables a quick and exact cross profile adjustment.

According to a further variant of the invention, the length of the guide surface is adjustable evenly substantially across the entire machine width. The length adjustment across the entire machine width, of course, can also be combined with the zonewise length adjustment.

The guide surface is detachably assembled to the applicator, allowing easy replacement and/or maintenance as needed.

Another feature of the invention provides for forming the guide surface of at least one section of the approach-side and/or departure-side lip. Hence, the guide surface can be integrated in the design of the metering system of the applicator and allows, as needed, easy adjustment of both the metering slot depth and the guide surface length.

In conjunction with the above features, the approach-side lip and departure-side lip can be movable relative to each other in a direction substantially parallel to the flow direction of the coating medium in the metering slot. The length of the guide surface can be adjusted by the relative movement. Depending on the adjustment of the lips, either a section of the approach-side lip or of the departure-side lip can form the length-adjustable guide surface. The arrangement of the guide surface may also be different than as described above.

In at least one embodiment of the inventional applicator, the guide surface is at least partly curved. Thus, the guide surface may have, e.g., a concave or a convex surface section. The curvature of the guide surface makes it possible to influence both the control of the stream and the stream characteristics of the liquid or pasty coating medium as well as the properties of the coating medium itself. A convex guide surface section, e.g., is usable for removal of air inclusions in the coating medium.

In this context it also has proved advantageous that at least one radius of curvature of the guide surface is adjustable. Thus, the guide surface can be very easily and quickly adapted to varied operating conditions and a different coating medium, and specific properties of the open jet can be achieved.

Similar advantages derive from the adjustability of at least one angle of curvature of the guide surface, according to a further variant. Besides, the adjustment of the angle of curvature can also be employed for adjustment of the angle of impingement. The angle of impingement is defined as the angle between the open jet impinging on the traveling fiber material web or the applicator roll and a tangent to the material web or the applicator roll at the point of impingement.

The applicator is suitably equipped with at least one length adjustment system for adjusting the length of the guide surface.

To adjust the radius of curvature of the guide surface, the applicator includes, according to a further embodiment of the invention, at least one adjustment system for the radius of curvature.

A further variant of the inventional applicator provides for at least one angle-of-curvature adjustment system to adjust the angle of curvature of the guide surface.

The above adjustment systems may be, e.g., suitable mechanical, electrical, electromagnetic, magnetic, magnetostrictive, piezoelectric, pneumatic, hydraulic adjustment systems or the like, as well as combinations thereof.

In a further inventional embodiment, the applicator possesses at least one control system. The length adjustment system and/or the radius-of-curvature adjustment system and/or the angle-of-curvature adjustment system are incorporated in at least one loop of this control system. The control system serves to automatically adjust the adjustment systems on the basis of the measured values of the cross profile and, as the case may be, other parameters of the applied coating medium, zonewise and/or across the entire machine width. The control system allows, during operation of the applicator, a quick and reliable adaptation to varying operating conditions as well as a swift and exact correction of the cross profile.

The objective underlying the invention is satisfied, furthermore, by an inventional method with the features of claim 14.

In this method for direct or indirect application of a liquid or pasty coating medium onto a traveling material web, notably of paper or cardboard, by use of an applicator including at least one metering system with a metering slot configured as an open-jet nozzle between an approach-side lip and a departure-side lip, from which metering slot the coating medium exits in the form of an open jet, the issuing open jet of coating medium is passed along at least one guide surface. The length of the guide surface is adjusted in at least one direction substantially parallel to the flow direction of the coating medium along the guide surface. It is pointed out that the length adjustment of the guide surface is suitably made only as needed, that is, for example, to adjust or regulate a specific cross profile of the coating medium applied or being applied. The length adjustment of the guide surface may be effected depending on or independently of any zonewise or uniform adjustment of the metering slot depth effected across the entire machine width. The inventional method offers the advantages already illustrated in conjunction with the inventional apparatus.

The adjustment of the guide surface length may be made, in the purport of the invention, zonewise and/or uniformly substantially across the entire machine width of the applicator.

According to a further variant of the inventional method, the length adjustment of the guide surface occasions an adjustment of the velocity ratio $v_{open\ jet}/v_{material\ web}$, where $v_{open\ jet}$ is the velocity of the coating medium issuing out of the metering slot and $V_{material\ web}$ is the speed of the traveling fiber material web. As already illustrated above in conjunction with the inventional applicator, extending or shortening the guide surface makes it possible to effectively influence the local jet velocity, namely the $v_{open\ jet}$, and thus the velocity ratio, which in view of the achieved applicational result represents a major parameter.

Moreover, the inventional method also provides for a variation of at least one radius of curvature of the guide surface and/or a variation of at least one angle of curvature of the guide surface. The effects of such variations have already been illustrated in conjunction with the inventional applicator, making further comments dispensable.

In this method for direct or indirect application of a liquid or pasty coating medium onto a traveling material web, notably of paper or cardboard, by use of an applicator including at least one metering system with a metering slot configured as an open-jet nozzle between an approach-side lip and a departure-side lip, from which metering slot the coating medium issues as an open jet, the issuing open jet is passed along at least one guide surface that has a constant length. As needed, either the angle of curvature and/or the radius of curvature and/or the partial lengths between at least two sections of the guide surface separated by a curvature and/or different angles of curvature are adjusted either evenly across substantially the entire machine width or zonewise differently. This method, too, offers the advantages already illustrated in conjunction with the inventional apparatus.

BRIEF DESCRIPTION OF THE DRAWINGS

The above-mentioned and other features and advantages of this invention, and the manner of attaining them, will become is more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1A:
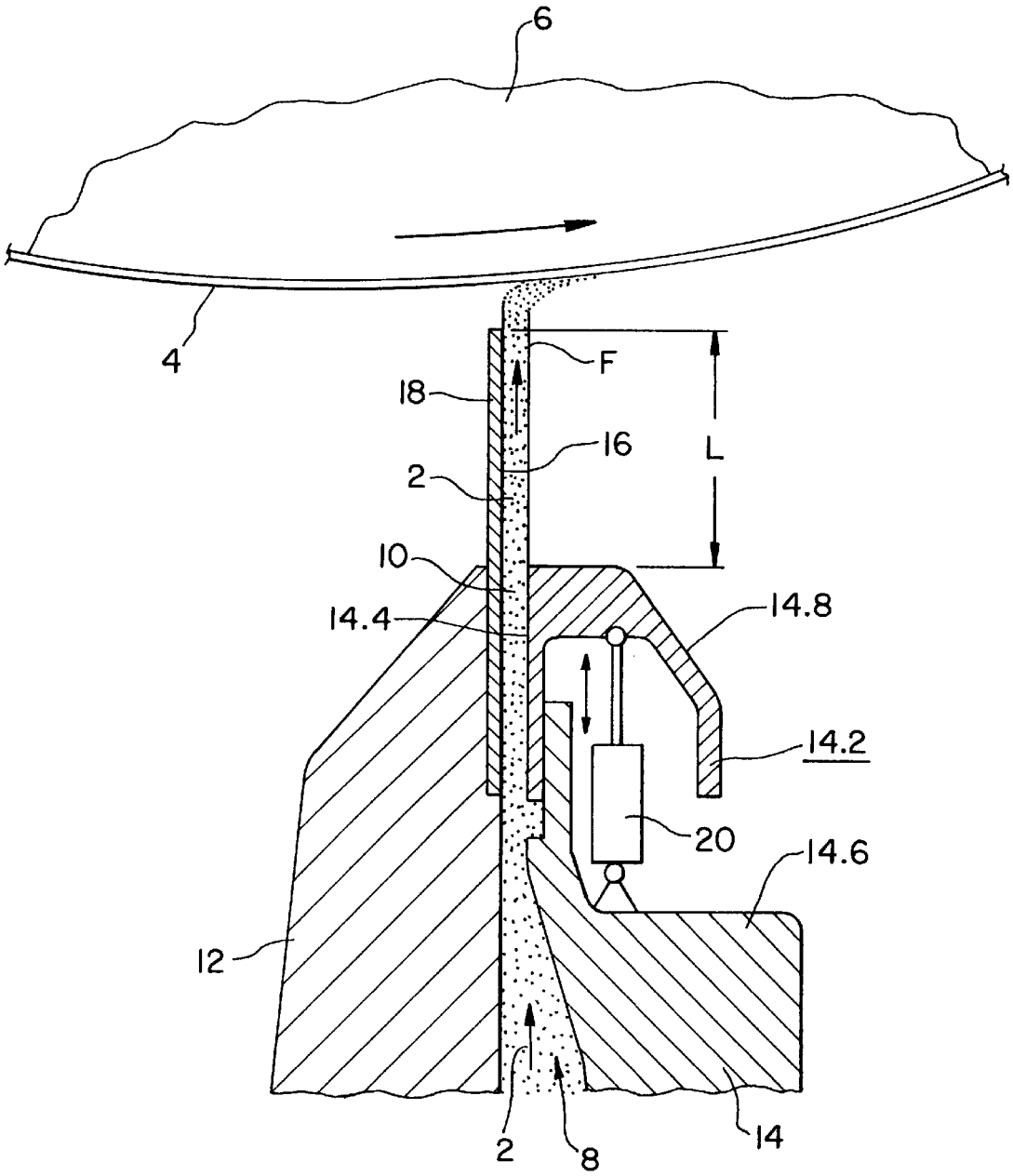
FIG. 1*a* is a schematic, side, cross-sectional illustration of a first embodiment of the inventional applicator in the area of the metering system.

Referring now to the drawings, and more particularly to FIG. 1*a*, there is shown a schematic, side, cross-sectional view of a first embodiment of the inventional applicator for direct or indirect application of a liquid or pasty coating medium 2 onto a traveling material web 4, notably of paper or cardboard, in the area of the applicator and metering system, opposing a backing roll 6 that supports fiber material web 4. The direction of rotation of backing roll 6 is indicated by an arrow. The applicator includes a beam that extends across the entire width of the applicator. The beam houses a manifold for the liquid or pasty coating medium to be applied. Bordering on the manifold and connected by way of conduits is an equalization space that extends in a feed conduit 8. Feed conduit 8 empties into a metering slot 10 formed between an approach-side lip 12 and a departure-side lip 14. Out of metering slot 10 issues the pressurized coating medium 2 in an open jet F. As follows from the drawing figure, the approach-side lip 12 is disposed on the side of the metering slot 10 which the backing roll 6 approaches, while the departure-side lip 14 is disposed on the opposite side of the metering slot 10 from which the backing roll 6 departs the metering slot 10. The embodiment is equipped with a not illustrated slot depth adjustment system adapted for moving the approach-side lip 12 and the departure-side lip 14 relative to each other for adjustment of the slot depth. Similarly, of course, a metering system with a fixed metering slot depth can be used as well. Omitted from the drawing figure, for clarity, are the aforementioned beam with its manifold and the equalization space as well as a doctor system which usually follows the metering system.

As follows from FIG. 1*a*, furthermore, a thin, straight guide panel 18, detachably assembled to the approach-side lip 12, borders on the exit of metering slot 10 and extends beyond the free end of the departure-side lip 14. The guide panel 18 has on the metering slot side a guide surface 16 whose length L, from the exit of metering slot 10 to the free end of guide surface 16, is continuously adjustable in a direction substantially parallel to the flow direction of coating medium 2 along guide surface 16. This length adjustability of guide surface 16 is made possible by a substantially U-shaped profile 14.2 arranged on departure-side lip 14. Profile 14.2 is movable relative to a fixed section 14.6 of departure-side lip 14 in a direction substantially parallel to guide surface 16, with one side surface 14.4 of U-shaped profile 14.2 forming a section of the metering slot wall. Provided for adjustment of length L of guide surface 16 is a length adjustment system 20 that attaches both to the U-shaped profile 14.2 and the fixed section 14.6 of the departure-side lip 14. Length adjustment system 20 is movable in the direction indicated in the drawing by a double arrow.

The side of the U-shaped profile 14.2 away from metering slot 10 includes a beveled section 14.8 that overreaches the length adjustment system 20 and serves as a run-off surface for surplus coating medium 2. Suitable sealing elements may be provided between the movable U-shaped profile 14.2 and the fixed section 14.6 of the departure-side lip 14. These are omitted from the drawing. The length adjustment system 20 includes in the embodiment of FIG. 1*a* a plurality of actuators 20, e.g., pneumatic actuators. Actuators 20, in the width direction of the applicator, are mutually spaced sideways, making length L of guide surface 16 either zonewise or uniformly adjustable as needed substantially across the entire machine width. This is accomplished with the aid of the actuators 20 acting either zonewise differently or uniformly on the U-shaped profile 14.2. The design of the U-shaped profile 14.2 may be such that it extends continuously substantially across the entire machine width of the applicator. In this case, the zonewise length adjustability at variable operation of the actuators 20 is assured by the elasticity of the profile 14.2, deforming in keeping with the effect of the actuators. Or, the zonewise length adjustability of actuators 20 can be assured by the subdivision of profile 14.2 in separate adjacent elements which in length adjustment direction are appropriately movable relative to one another.

Figure 1B:
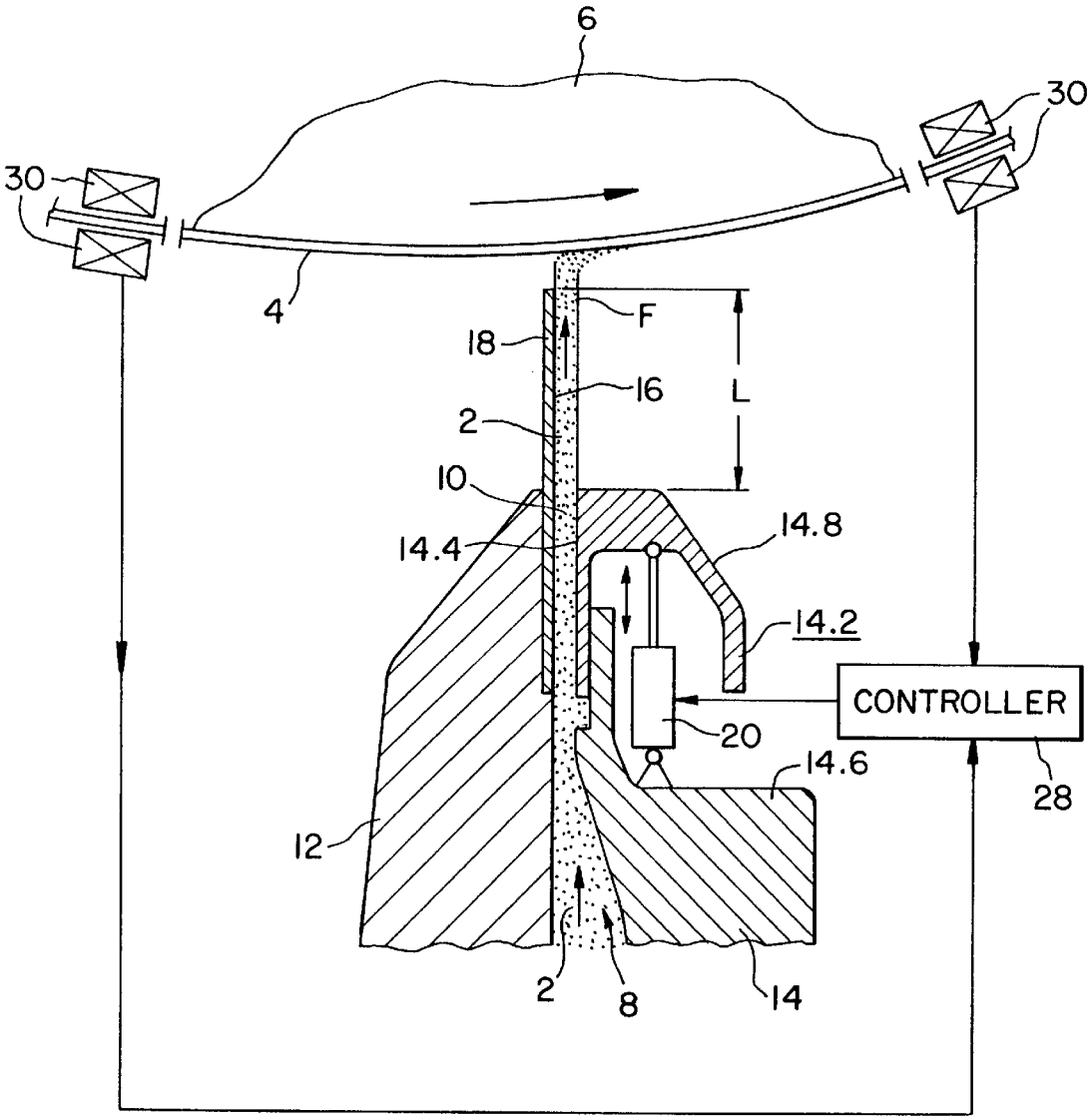
FIG. 1*b* is a schematic, side, cross-sectional illustration of the applicator of FIG. 1*a* including a control system.

FIG. 1*b* illustrates the applicator of FIG. 1*a*, including a control system having a controller 28 with a control loop that incorporates the length adjustment system 20, sensors 30, and the metering slot depth adjustment system (not shown). Sensors 30 measure the thickness of web 4 both before and after the application of coating medium 2. A controlled length adjustment is effected here, depending on application, that is dependent or independent of an actuation of the metering slot depth adjustment system.

Figure 2:
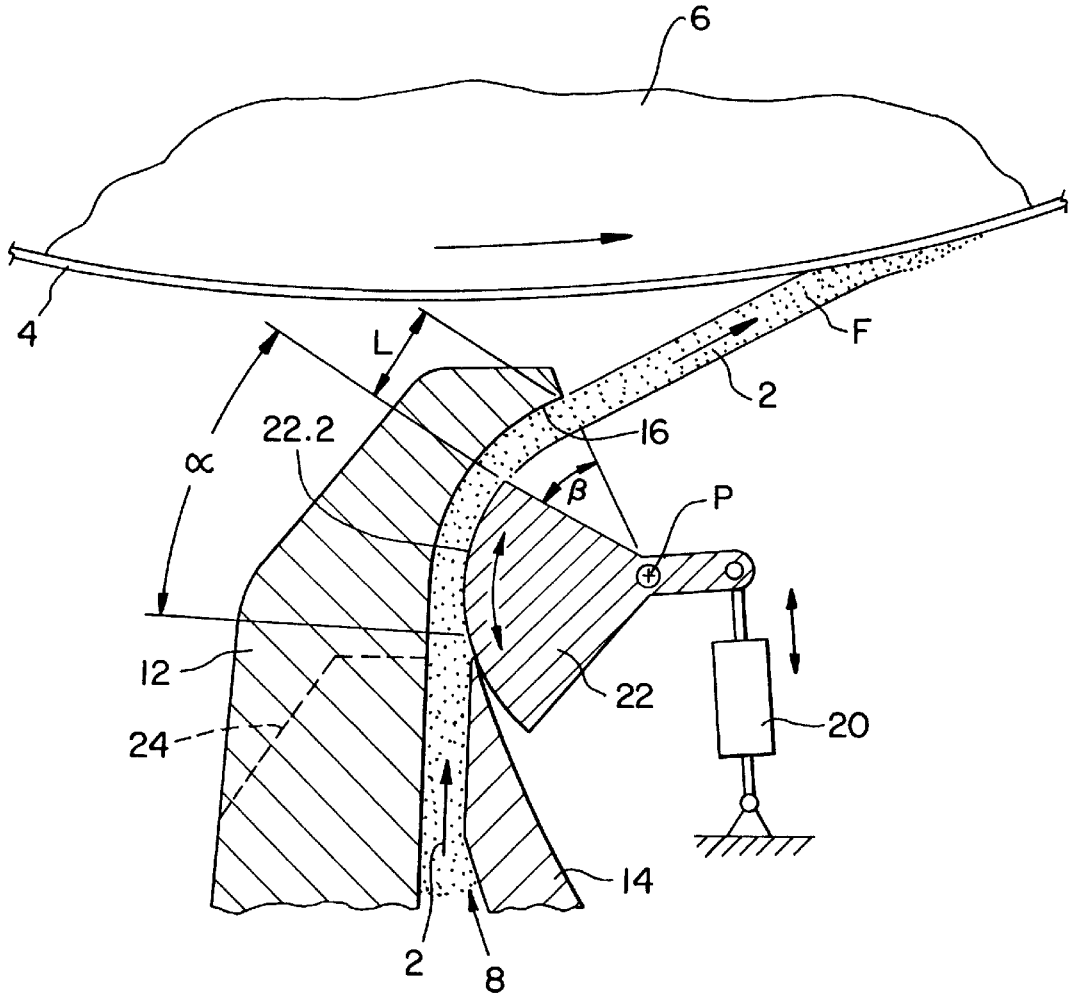
FIG. 2 is a schematic, side, cross-sectional illustration of a second embodiment of the inventional applicator in the area of the metering system.

FIG. 2, analogous to FIG. 1*a*, shows a schematic, side, cross-sectional illustration of a second embodiment of the inventional applicator in the area of the metering system. In this variant, a guide surface 16 of concave curvature and length L is formed on the free end of the approach-side lip 12 and extends beyond the free end of the departure-side lip 14. Extending across the entire machine width, a sector-like profile 22 is arranged pivotably in the area of the departure-side lip 14. Profile 22 has an arcuate section 22.2, facing metering slot 10, which moves upon pivoting by the angle β along the tapering end of the departure-side lip 14. The radius of the arcuate section 22.2 is adapted to the radius of the opposing concave guide surface 16 and the width of metering slot 10. The length L of guide surface 16 is shortened or lengthened accordingly by pivoting the sector-like profile 22 about its fulcrum P, thereby achieving an adjustment across the entire machine width. In this configuration, as depicted in FIG. 2, the angle of curvature α of guide surface 16 can also be adjusted along with the length adjustment of guide surface 16. Acting as a length adjustment system, actuator 20 assumes at the same time the function of an angle-of-curvature adjustment system.

Suitable selection of the radius of curvature of the sector-like profile 22 and arrangement of fulcrum P allows a depth adjustment of metering slot 10 to be achieved along with a length change of guide surface 16. Also possible is an embodiment making do without a concave guide surface 16, the approach-side lip 12 then having a configuration, e.g., such as indicated in FIG. 2 by the dashed line 24. The arcuate section 22.2 of the sector-like profile 22 acts then as a convex guide surface whose length is adjustable in the way described above. Also possible is an arrangement in which the point P is variable in one or two axes or on a circular arc.

Figure 3:
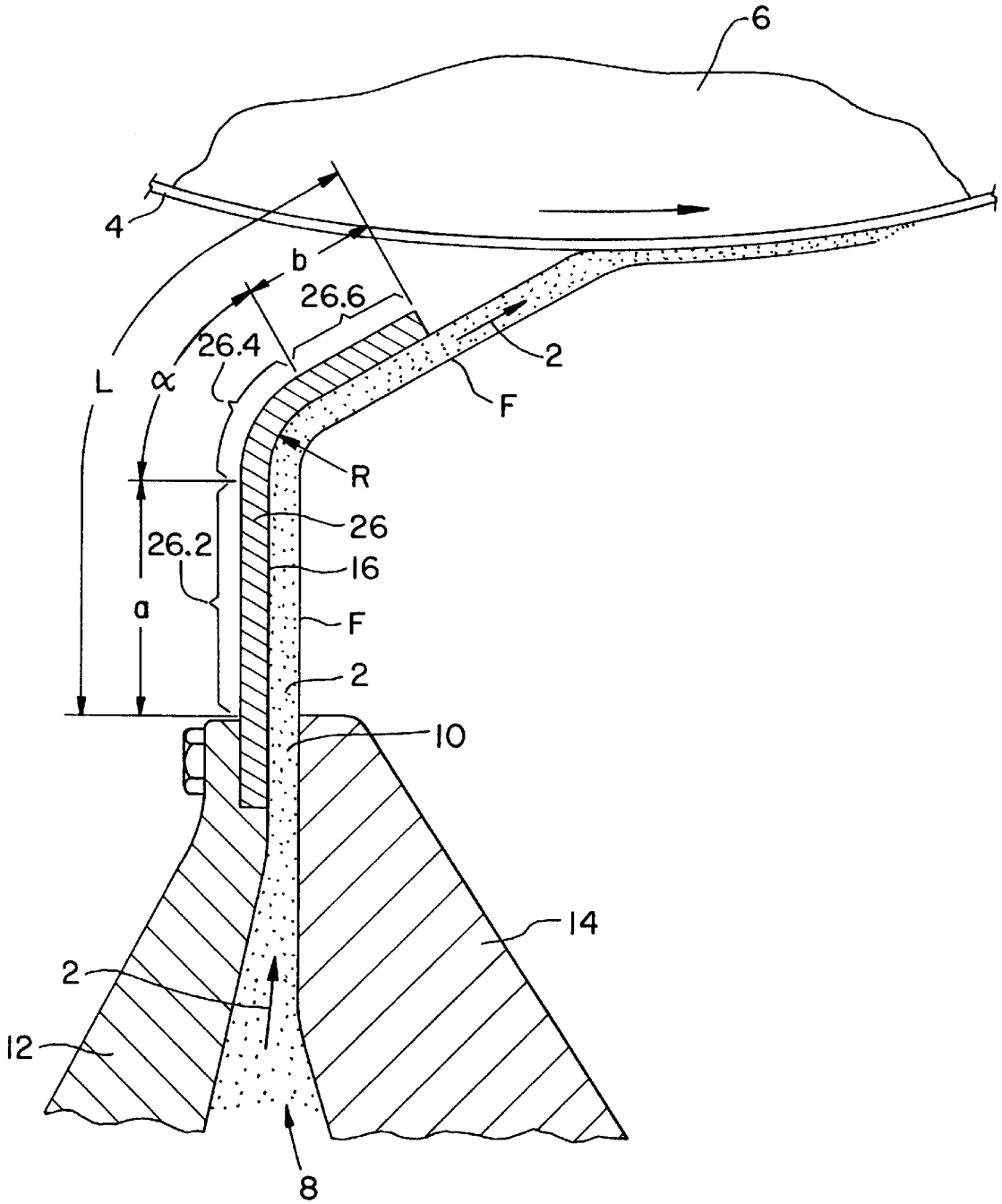
FIG. 3 is a schematic, side, cross-sectional illustration of a third embodiment of the inventional applicator in the area of the metering system.

FIG. 3, analogous to FIG. 1*a*, shows a schematic, side, cross-sectional illustration of a third embodiment of the inventional applicator in the area of the metering system. This variant possesses a guide surface 16 bordering on the exit of metering slot 10 and contained on the free end of the approach-side lip 12. Guide surface 16 is formed by an angled guide panel 26 assembled to the approach-side lip 12. Its guide surface 16 of overall length L extends from the exit of metering slot 10 up to the free end of guide panel 26. Guide panel 26 includes a first straight section 26.2 of length a that borders on the exit of metering slot 10, a curved section 26.4 following section 26.2 and having an angle of curvature α and a radius of curvature R, and a second straight section 26.6 of length b following the curved section 26.4. The overall length L of guide surface 16, or the length of the controlled stream, is here $$L = a + \frac{\alpha}{360} 2\pi R + b$$

Although for easier illustration a guide panel 26 with a guide surface 16 of constant length is shown in the embodiment according to FIG. 3, the guide surface variables a, b, L, α and R are to be viewed as variable in the sense of the invention. An appropriate variation can be carried out either by replacement of guide panel 26 or by providing appropriate adjustment systems and configurations, such as described, for example, in FIGS. 1*a* and 2. Also illustrated before in conjunction with FIGS. 1*a* and 2, the variation of the guide surface variables may be effected both zonewise and uniformly across the entire machine width.

Allowing for the above configurations of guide surface 16 according to FIG. 3, a variation or adjustment of guide surface variables a, b, L, α and R provides the adjustment options listed in the following Table 1:

TABLE 1

| Adjustment/ Variation of | Zonewise adjustable | Machinewide adjustable | Exchange guide surface |
|---|---|---|---|
| Overall length L | X | X | X |
| Length a | X | X | X |
| Length b | X | X | X |
| Radius R | X | X | X |
| Angle α | X | X | X |

The effect on the influential width caused by an adjustment or variation of a guide surface variable, which may be effected both separately and in combination with at least one further guide surface variable, and the amplitude of a disturbance in the cross profile of the applied liquid or pasty coating medium were experimentally determined by the inventors of the present applicational object with the aid of the configuration shown in FIG. 3 and are listed in the following Table 2:

TABLE 2

| Adjustment/ Variation of | Mode of Adjustment | Effect on Influential Width | Effect on Amplitude |
|---|---|---|---|
| L | greater | greater | smaller |
| a | greater | greater | smaller |
| b | greater | greater | smaller |
| R | greater* | smaller | greater |
| α | greater* | greater | smaller |

*with L = constant

In supplementation to Table 2 it is noted that with a variation of variable α an impingement angle adjustment can also be effected. Depending on the configuration of the guide surface and the respective guide surface parameters, notably the overall length and the length of individual sections of the guide surface, different effects with respect to the application applied or to be applied with the inventional applicator, notably of the cross profile, can be achieved. Therefore, the data compiled in the above Tables 1 and 2 should be understood merely as exemplary.

Figure 4A:
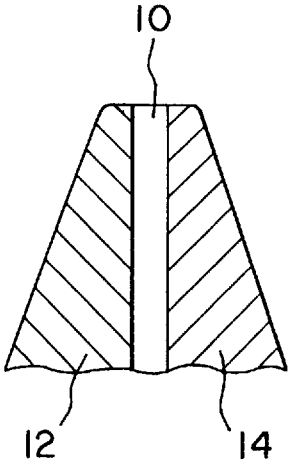
FIGS. 4*a*, 4*b* and 4*c* are schematic, side, cross-sectional illustrations of a fourth embodiment of the inventional applicator in the area of the metering system.
Figure 4B:
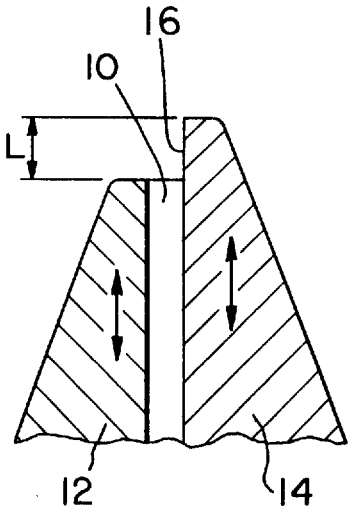
Figure 4C:
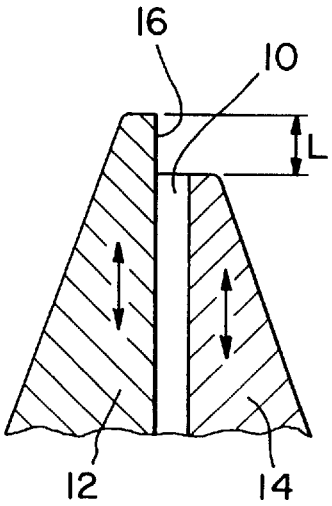

FIGS. 4*a*–4*c*, analogous to FIG. 1*a*, show schematic, side, cross-sectional illustrations of a fourth embodiment of the inventional applicator in the area of the metering system. The approach-side lip 12 and departure-side lip 14 are in this applicator movable relative to each other in a direction substantially parallel to the flow direction of the coating medium 2 in metering slot 10. The length L of the guide surface 16 formed by a section of the approach-side lip 12 or departure-side lip 14 is adjustable due to the relative movement. In the neutral position sketched in FIG. 4*a*, the approach-side lip 12 and departure-side lip 14 are each extended to the same level, so that no guide surface exists. FIG. 4*b* shows a configuration where the approach-side lip 12 and the departure-side lip 14 have been moved relative to each other such that the top section of the departure-side lip 14 extends beyond the free end of the approach-side lip 12 and its side surface coordinated with metering slot 10 forms a straight guide surface 16 of length L. The guide surface length L is variable here by a further relative movement of the lips 12, 14 in the direction indicated by arrows. In FIG. 4*c*, the relative positions of the two lips 12 and 14 are exactly switched as compared to the configuration shown in FIG. 4*b*. Adjustable in its length L, guide surface 16 is formed here by a side surface of the approach-side lip 12. As can be seen, the relative movement of the approach-side lip 12 and departure-side lip 14 not only allows adjusting the length L of guide surface 16, but also switching its "arrangement," or position (compare FIG. 4*b* and FIG. 4*c*). The embodiment according to FIGS. 4*a*–4*c* is also usable when one of the lips 12, 14 has a curved guide surface.

The liquid or pasty coating medium 2 issuing in the operation of the applicators described in conjunction with FIGS. 1*a* through 4*c* as open jet F from metering slot 10 is passed along guide surface 16. The influential width, and with it the cross profile of the applied medium, is regulated, if needed, by adjusting the length of guide surface 16 or of partial lengths a, b of the length L in at least one direction substantially parallel to the flow direction of the coating medium 2 along guide surface 16. The length adjustment is zonewise or uniform across the entire machine width of the applicator. Effected with a length adjustment of guide surface 16 can also be an adjustment of the velocity ratio $v_{open\ jet}/v_{material\ web}$, where $v_{open\ jet}$ is the velocity of the coating medium 2 issuing out of the metering slot 10 and $v_{material\ web}$ is the speed of traveling fiber material web 4. In the embodiments according to FIGS. 2 and 3, as already mentioned, the particular configuration of guide surface 16 additionally allows a variation of the angle of curvature $\alpha$ of the guide surface.

Figure 5:
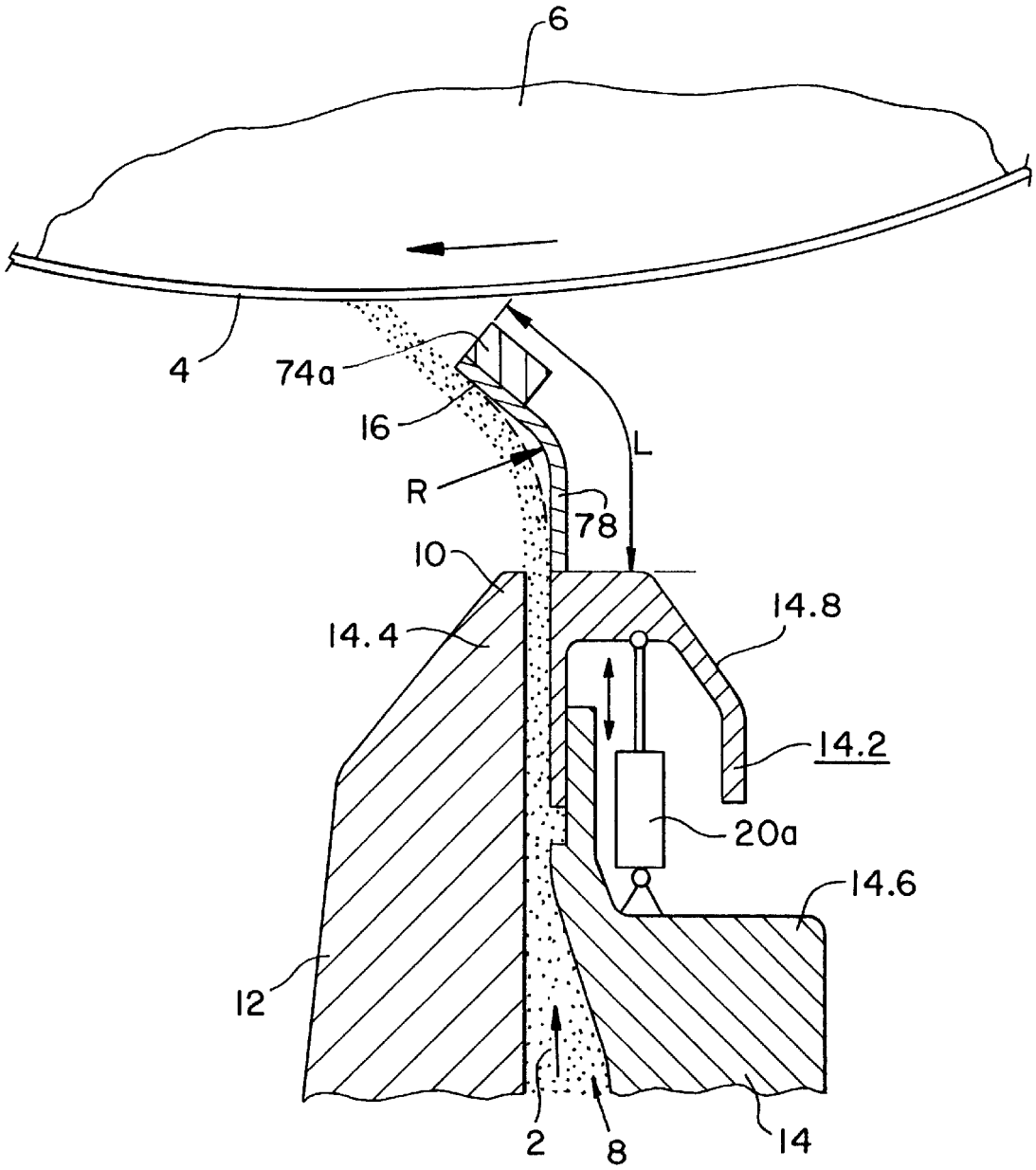
FIG. 5 is a schematic, side, cross-sectional illustration of a fifth embodiment of the inventional applicator in the area of the metering system including a radius-of-curvature adjustment system.

In the fifth embodiment of the inventional applicator according to FIG. 5, a variation of the radius of curvature R of guide surface 16 is possible using a radius-of-curvature adjustment system including a lip bracket 14*a*. Lip bracket 14*a* is rigidly attached to both guide panel 18 and lip 14. Actuator 20*a* is configured to make relatively fine adjustments to the vertical position of U-shaped profile 14.2, thereby flexing guide panel 18 against the fixed lip bracket 14*a*. The flexing of guide panel 18 results in an adjustment of radius of curvature R of guide surface 16.

The invention is not limited to the above exemplary embodiments, which merely serve as general explanation of the basic idea of the invention. Rather, the inventional applicator may within the scope of protection also assume configurations other than those described above. Specifically, the applicator may have features that represent a combination of the respective individual features. Moreover, guide surface configurations other than those explained and illustrated in the drawings can be realized, for example, guide panels with multiple curvatures or angles. While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for one of direct and indirect application of a coating medium having a flow direction onto a traveling fiber material web having a width, said applicator comprising:

at least one metering system including an approach-side lip and a departure-side lip defining a metering slot therebetween, said metering slot being configured as an open-jet nozzle and having an exit;

at least one arcuate profile surface adjacent to said exit of the metering slot, said at least one arcuate profile surface configured for guiding the coating medium as an open jet out of said metering slot, said at least one arcuate profile surface being rotatable in at least one direction substantially parallel to the flow direction of the coating medium to thereby provide said at least one arcuate profile surface with an adjustable length; and at least one guide surface adjacent to said exit of the metering slot, said at least one guide surface being disposed opposite said at least one arcuate profile surface.

* * * * *